US010799878B2

(12) United States Patent
Seiler

(10) Patent No.: US 10,799,878 B2
(45) Date of Patent: Oct. 13, 2020

(54) MULTI-REGION TWIN-SHAFT CUTTING SYSTEM

(71) Applicant: Lindner-Recyclingtech GmbH, Spittal/Drau (AT)

(72) Inventor: Stefan Seiler, Heringen/Werra (DE)

(73) Assignee: Lindner-Recyclingtech GmbH, Spittal/Drau (AT)

( * ) Notice: Subject to any disclaimer, the term of this patent is extended or adjusted under 35 U.S.C. 154(b) by 329 days.

(21) Appl. No.: 14/421,937

(22) PCT Filed: Aug. 9, 2013

(86) PCT No.: PCT/EP2013/066682
§ 371 (c)(1),
(2) Date: Feb. 16, 2015

(87) PCT Pub. No.: WO2014/026916
PCT Pub. Date: Feb. 20, 2014

(65) Prior Publication Data

US 2019/0151856 A1 May 23, 2019

(30) Foreign Application Priority Data

Aug. 16, 2012 (EP) ..... 12005918

(51) Int. Cl.
*B02C 18/18* (2006.01)
*B02C 18/14* (2006.01)
(Continued)

(52) U.S. Cl.
CPC ..... *B02C 18/142* (2013.01); *B02C 18/0084* (2013.01); *B02C 18/18* (2013.01);
(Continued)

(58) Field of Classification Search
CPC .. B02C 18/142; B02C 18/0084; B02C 18/182
(Continued)

(56) References Cited

U.S. PATENT DOCUMENTS 39,835 A * 9/1863 Reece ..... B02C 18/182 241/295
1,435,330 A * 11/1922 Pardee ..... B02C 18/14 241/235
(Continued)

FOREIGN PATENT DOCUMENTS

DE 2831953 A1 12/1979
DE 9415955 U1 11/1994
(Continued)

OTHER PUBLICATIONS

European Office Action issued by the European Patent Office for corresponding European Patent Application No. EP 12005918.3 dated Dec. 6, 2017.

*Primary Examiner* — Faye Francis
(74) *Attorney, Agent, or Firm* — Moore & Van Allen PLLC; Henry B. Ward, III

(57) ABSTRACT

A multi-region twin-shaft cutting system for chopping material. The cutting system includes two shafts which are arranged in parallel and are driven in an opposed manner, each shaft is surrounded by a roll body. The system additionally includes a multiplicity of supporting elements, each supporting element is fitted radially around the roll body. The system further includes a multiplicity of severing elements which are of disc- and/or plate-like design and are each fitted symmetrically or asymmetrically tangentially to the circumferential region of the supporting elements.

18 Claims, 5 Drawing Sheets

(51) Int. Cl.
*B02C 18/00* (2006.01)
*B02C 18/22* (2006.01)
*B02C 18/24* (2006.01)
*B02C 18/16* (2006.01)

(52) U.S. Cl.
CPC ..... *B02C 18/182* (2013.01); *B02C 18/2216* (2013.01); *B02C 18/24* (2013.01); *B02C 2018/162* (2013.01); *B02C 2201/06* (2013.01)

(58) Field of Classification Search
USPC ..... 241/236, 295
See application file for complete search history.

(56) References Cited

U.S. PATENT DOCUMENTS 2,472,188 A * 6/1949 Bennett ..... F25C 5/046 241/243
3,027,106 A * 3/1962 Brooks ..... B27B 33/20 241/294
3,261,384 A * 7/1966 Henderson ..... B23D 61/06 83/839
4,165,043 A * 8/1979 Higashi ..... B02C 18/182 241/236
4,765,217 A * 8/1988 Ludwig ..... B23D 61/04 83/835
4,867,026 A * 9/1989 Henning ..... B23D 61/021 83/835
5,048,764 A 9/1991 Flament
5,481,952 A * 1/1996 MacLennan ..... B23D 61/06 83/676
5,511,729 A * 4/1996 Husain ..... B02C 18/142 241/166
5,676,321 A * 10/1997 Kroger ..... B02C 18/182 241/236
5,904,305 A * 5/1999 Kaczmarek ..... B02C 18/14 241/157
6,616,077 B2 * 9/2003 Koenig ..... B02C 18/142 241/230
6,969,017 B2 * 11/2005 Irwin ..... B02C 18/142 241/166
7,311,279 B2 * 12/2007 Mathers ..... B02C 18/142 241/166
7,328,867 B1 * 2/2008 Lo ..... B02C 18/0007 241/100
7,533,839 B2 * 5/2009 Wang ..... B02C 18/0007 241/236
D594,040 S * 6/2009 Cadwallader ..... D15/138
7,641,135 B1 * 1/2010 Lo ..... B02C 18/0007 241/100
7,658,343 B2 * 2/2010 Potts ..... B02C 4/18 241/158
8,418,947 B2 * 4/2013 Chan ..... B02C 18/0007 241/236
2002/0036245 A1 * 3/2002 Irwin ..... B02C 18/142 241/36
2002/0096584 A1 * 7/2002 Ho ..... B02C 18/0007 241/236
2004/0104289 A1 * 6/2004 Schwelling ..... B02C 18/0007 241/236
2004/0262436 A1 * 12/2004 Lo ..... B02C 18/0007 241/236
2005/0263633 A1 * 12/2005 Vantrease ..... B02C 18/142 241/236
2006/0102763 A1 * 5/2006 Bai ..... B02C 18/0007 241/295
2007/0063084 A1 * 3/2007 New ..... B02C 18/0007 241/295
2007/0125895 A1 * 6/2007 Chen ..... B02C 18/16 241/236
2007/0152089 A1 * 7/2007 Chen ..... B02S 18/183 241/236
2007/0181721 A1 * 8/2007 Ko ..... B02C 18/0007 241/100
2007/0295845 A1 * 12/2007 Huang ..... B02C 18/0007 241/295
2013/0015280 A1 * 1/2013 Tamaki ..... B02C 18/0007 241/236

FOREIGN PATENT DOCUMENTS

DE 102005026816 A1 12/2006
DE 202007007982 U1 10/2007
DE 102009038984 A1 2/2011
EP 0529221 B1 9/1996
FR 2427845 A1 1/1980

* cited by examiner

MULTI-REGION TWIN-SHAFT CUTTING SYSTEM

FIELD OF THE INVENTION

The present invention relates to a multi-region twin-shaft cutting system for comminuting material, in particular in the form of waste products.

BACKGROUND OF THE INVENTION

Commercial waste, industrial waste, domestic waste, production waste, e.g. (hard) plastics, textiles, composites, rubber, wood, or waste wood (such as pallets and chipboard), biomass, shrubbery, home and construction waste etc, prior to their final disposal or especially prior to returning them into the recovered substance cycle and for energy recovery require comminuting. Prior art knows single- or multiple-shaft choppers which are charged, for example, by wheeled loaders, forklifts, conveyors, or via a hopper for material supply.

The material to be comminuted is, for example, by feeding elements conveyed into the severing region of the shafts and processed there.

EP 0529221 B1 describes a twin-shaft comminuting system with breaking rollers driven in opposite manner.

Due to the breaking tools, a high and today inappropriate amount of energy demand/energy expenditure arises for prior art comminuting. Coarse and undefined comminuting additionally results in the final product having a high proportion of unwanted oversize particles. This complicates further processing and marketing of the comminuted material.

Comminuting systems according to prior art are available also following the twin-shaft principle. However, they have the problem that the throughput is tremendously reduced because the tools must be built closer together to prevent a high proportion of outliers, i.e., unwanted oversize particles.

There is also the problem that wear within a comminuting unit drastically increases by blocking and grinding material thereby greatly reducing service life.

All these systems have only 1-2 severing levels or severing processes during one passage, i.e. one rotation of the comminuting tools and are therefore often not economically viable enough.

It is the object of the new multi-region twin-shaft comminuting system, m view of the problems of prior art discussed above, to provide a multi-region twin-shaft comminuting system, a more economical and efficient, in particular a more energy-efficient comminuting system, wherein the efficiency of comminuting during one passage, i.e. in one rotation of the comminuting tools, is increased. Furthermore, the system is to have reduced wear at the comminuting system and the comminuting tools as compared to prior art.

BRIEF SUMMARY OF THE INVENTION

The above object is satisfied by a multi-region twin-shaft cutting system described in greater detail below.

The invention provides a multi-region twin-shaft cutting system for comminuting material, comprising: two shafts which are arranged substantially parallel and are driven in an opposite manner, wherein each shaft is in each case surrounded by a roll body; a multiplicity of supporting elements, wherein each supporting element is fitted substantially radially around the roll body, wherein each supporting element preferably has a radial, undulatory, rounded or angular or edged, symmetrical or asymmetrical a circumferential line; a multiplicity of severing elements which are of disc- and/or plate-like design and are each fitted substantially tangentially to the circumferential region of the supporting elements: where the supporting elements are arranged at a distance around the roll bodies in such a manner that in each case one severing element on one supporting element of the one shaft can engage between two directly adjacent supporting elements of the other shaft; wherein, for each shaft, counter severing elements are fitted in each case between two directly adjacent supporting elements of said shaft, on the roll body of the shaft, said counter severing elements being fitted in a corresponding manner to the severing elements of the other shaft such that the severing elements of the other shaft, on opposite engagement in the intermediate space between the two directly adjacent supporting elements of the one shaft, operate counter to the corresponding counter severing elements, in particular in a cutting manner, such that the material is comminuted.

The two shafts driven in opposite manner are typically arranged in parallel at a distance, so that the severing elements of the one shaft can engage between two directly adjacent supporting elements of the other shaft. A gap thereby arises between the two shafts in which the comminuting of the material to be comminuted occurs. It is understood that the respective severing elements of the one shaft there do not reach the outer surface of the roll body. The roll body can there also have a different geometry, such as a polygonal geometry, for example be hexagonal or octagonal. It is further understood that also at least the outer regions of each respective severing element of the one shaft during engagement in opposite manner engage in the space between two directly adjacent supporting elements of the other shaft. The supporting elements are typically formed disk-shaped. The opposite direction of drive of the two shafts defines for example a feeding region of the system such as above an imaginary plane being drawn through the two longitudinal axes of the shafts and a discharge region below this plane, where these regions are for instance defined upwardly by the beginning of the engagement in opposite directions, downwardly for instance by the end of the engagement in opposite directions of the two shafts.

The severing elements of the one shaft fitted tangentially on the supporting elements can in particular be effectively supported in their function by counter severing elements that are arranged correspondingly located on the roll body of the other shaft. A severing element can there operate counter to a counter severing element. The term operate is there meant such that material is comminuted, in particular cut, between the severing element and the corresponding counter severing element. The term arranged correspondingly is to mean that the arrangement of the elements mentioned, i.e. the severing elements, the counter severing element, the supporting elements, during rotation of the shafts in opposite directions, these elements approach each other such that material is comminuted between these elements. There is typically a corresponding counter severing element for each severing element. It is there understood that the counter severing element can be formed integrally, but it is also possible to have the counter severing element be composed of several pieces. It is understood that a multiplicity of severing elements can typically be fitted symmetrically at the circumferential region of the supporting elements. The typically disk-like, circumferentially undulatory shape of the supporting elements promotes better circulation of the material to be comminuted and simultaneously facilitates or optimizes material to be drawn in. The supporting elements can preferably have a shaft-shaped or rosette-shaped circumferential line or circumference region. Circulation and drawing-in can thereby be further improved tremendously. Energy consumption for comminuting is thereby at the same time reduced. The number of maxima of the shaft-shape of the supporting elements can be designated by n, where n is a natural number. The severing elements can be fitted at all or at least at some of these maxima. The number of severing elements can be, for example, n=4 or n=6, according to the number of maxima. However, a different number of severing elements is also conceivable. The severing elements are fitted around the supporting element typically symmetrically, but also non-systematically. This also applies to the supporting elements which, for example, have no shaft shape at the circumference. The symmetry n will typically be the same for all supporting elements, but can also be chosen differently.

Severing elements of the one shaft can in the multi-region twin-shaft cutting system each at least at their leading edge relative to the counter severing elements of the other shaft comprise a cutting area which is, for example, beveled.

The disk-like and/or plate-like and/or knife-like severing elements can have the shape of a rectangle, a parallelogram or a square. It is understood that the severing elements are typically fitted to the supporting elements such that the severing element is fitted approximately in its center to the supporting element which is perpendicular thereto. The leading edge region of the severing elements facing the gap during rotation of the shafts in opposite manner, also in short referred to as the leading edge, can with a cutting region suitably exert more pressure on a smaller area so that the efficiency of the operation, i.e. comminuting by cutting counter to the counter severing element can be increased.

The severing elements of the shaft can in the multi-region twin-shaft cutting system in their width be formed such that the width is slightly smaller than the respective distance between the two oppositely disposed supporting elements, so that on opposite engagement of the severing elements of the shafts with the oppositely disposed supporting elements, a severing element of the one shaft operates laterally in a breaking and/or cutting manner counter to two directly adjacent supporting elements of the other shaft.

The severing elements of the one shaft can in the multi-region twin-shaft cutting system each be arranged in corresponding manner to the severing elements of the other shaft such that, on opposite engagement of the severing elements of the shafts, a severing element of the one shaft operates in a breaking manner counter to two directly adjacent severing elements of the other shaft.

The severing elements are, as described above, typically fitted to the supporting elements such that the severing element is fitted approximately in its center to the supporting element which is perpendicular thereto. A severing element of the one shaft is therefore fitted tangentially, approximately centrally on the supporting element A severing element of the one shaft, for reasons of simplicity referred to as the first severing element can engage between two adjacent supporting elements of the other shaft. These adjacent supporting elements of the other shaft in turn support severing elements moving in a direction opposite to the first severing element. Material to be comminuted can thereby be cut, torn or broken between the first severing element and an adjacent severing element of the other shaft. This comminuting typically occurs in the feeding region. The material to be comminuted can therefore be broken and/or cut and torn already at a very early stage.

The severing elements of the one shaft can in the multi-region twin-shaft cutting system each be arranged in corresponding manner to the severing elements of the other shaft such that, during opposite engagement of the severing elements of the shafts, a severing element of the one shaft operates in a cutting manner counter to a corresponding severing element of the other shaft, where in particular the leading edge of the severing element of the one shaft operates counter to the edge facing away from the leading edge of the other severing element.

As described above, a severing element of the one shaft, for reasons of simplicity referred to as the first severing element, can engage between two adjacent supporting elements of the other shaft. These adjacent supporting elements of the other shaft in turn support severing elements moving in a direction opposite to the first severing element. The severing elements of the other shaft can be arranged in a corresponding manner to the first severing element of the one shaft such that the leading edge of the first severing element can perform a comminuting operation counter to the edge facing away from the leading edge of the other severing element, i.e. the trailing edge. This typically results in an overlap in the axial direction between the leading edge of the first severing element and the trailing edge of the corresponding severing element. This typically occurs in the discharge region of the system. As a result, material is again comminuted.

The severing elements of the one shaft can in the multi-region twin-shaft cutting system each be arranged in a corresponding manner to the severing elements of the other shaft and the counter severing elements of the other shaft such that during a single opposite rotation of both shafts on opposite engagement of the severing elements of the shafts, initially one severing element of the one shaft operates in a cutting and/or breaking manner counter to a directly adjacent pair of supporting elements of the other shaft, then the severing element of the one shaft operates in a cutting manner counter to the counter severing elements of the other shaft corresponding to this severing element, and then the severing element of the one shaft operates in a cutting manner counter to the severing element of the other shaft which is fitted in a corresponding manner to this severing element, counter to the edge facing away from the leading edge of the other severing element.

The arrangement of the severing elements of the one shaft in corresponding manner to the severing elements of the other shaft and in corresponding manner to the counter severing elements of the other shaft therefore during a single opposite rotation of the two shafts allows for four severing processes/comminuting processes in terms of the material to be comminuted. The first severing process, for example, is that the material is drawn in, broken and torn between a severing element of the one shaft, for reasons of simplicity referred to as the first severing element, and a severing element of the other shaft, for reasons of simplicity referred to as the second severing element. The first severing process typically occurs in the feeding region of the two supporting elements of the other shaft. Immediately thereafter, the severing element of the one shaft is inserted between the two supporting elements of the other shaft. Due to the severing elements in their width being only slightly smaller than the distance between the supporting elements of the other shaft, a second predominantly breaking, but also cutting and tearing comminuting process occurs between the severing element and the undulatory formed lateral edges of the supporting element. This second severing or comminuting process typically occurs still in the feeding region of the two supporting elements. The material is thereafter, for example, during the same opposite rotation of the two shafts comminuted, severed, cut between the first severing element and a corresponding counter severing element of the other shaft.

This third severing process typically also occurs in a region between the two supporting elements of the other shaft. The material is thereafter, for example, during the same opposite rotation of the two shafts again comminuted, e.g. between the first separating element of the one shaft and the separating element of the other shaft. Where in particular the leading edge of the separating element of the one shaft operates counter to the edge facing away from the leading edge of the other separating element. This fourth separating process typically occurs in the discharge region of the system. The material can by combining the four separating processes be comminuted more efficiently and uniformly. A final product is created that is uniform in grain size and virtually free of undesirable oversize particles. The comminuting material can practically be directly marketed without further complicated subsequent techniques needing to be employed, such as screening. Furthermore, the energy demand for comminuting is greatly reduced due to uniform charging of the material to be comminuted and the undulatory shape of the supporting elements. Severing in four planes, i.e. in four sections during only one passage or rotation of the shafts, as described above, reduces energy consumption, wear and optimizes the uniformity of the discharged comminuted material.

Each severing element of the one shaft can in the mufti-region twin-shaft cutting system correspond to two counter severing elements of two directly adjacent supporting elements of the other shaft, where the two counter severing elements are spaced in the axial direction between the two supporting elements.

The counter severing elements can in the multi-region twin-shaft cutting system be provided directly on the supporting elements on the roll body.

The counter severing elements can practically be formed directly onto the supporting elements or be suitably fitted or welded to the supporting elements. It is understood that the radial height of the counter severing elements is typically less than the radial height of the supporting elements.

The counter severing elements can in the multi-region twin-shaft cutting system be ashlar-shaped or rectangular and in particular be provided in the axial direction perpendicular to the supporting elements.

The counter severing elements can in the multi-region twin-shaft cutting system each at their leading edges facing the other shaft comprise a cutting area which is, for example, beveled.

The counter severing elements can be ashlar-shaped or block-like, where an anvil-like effect against the corresponding severing elements is achievable. Similarly, the counter severing elements can in turn at their leading edges facing the other shaft comprise a cutting area which is, for example, beveled so that the respective cutting area of the counter severing element and the corresponding severing element can achieve a cutting effect.

The leading edges of the severing elements can in the multi-region twin-shaft cutting system be arranged in the axial direction substantially parallel to the longitudinal axis of the shaft or the leading edges of the severing elements can be arranged with an inclination at an angle $\alpha$ relative to the longitudinal axis of the shaft, where $0<\alpha<90°$, preferably $0°<\alpha<45°$.

Due to the inclination of the leading edges of the severing elements, the severing elements can be specifically adapted to the comminuting tasks.

The counter severing elements of the other shaft corresponding to the severing elements of the one shaft can in the multi-region twin-shaft cutting system be arranged according to the inclination of the corresponding severing elements.

The counter severing elements are typically arranged according to the inclination of the severing elements in order to achieve the highest possible efficiency. If the inclination is 0°, i.e., the leading edges of the severing elements are in the axial direction substantially parallel to the longitudinal axis of the shaft, then, for example, the inclination of the counter severing elements is also 0°.

The multi-region twin-shaft cutting system can further comprise a multiplicity of catch elements that can be fitted to at feast some of the supporting elements on their outer circumference substantially radially to the longitudinal axis of the shaft, where the catch elements are typically bent hook-like so that they primarily point towards the respective other shaft.

The catch elements can be provided, for example, on every second or third supporting element. For one supporting element with catch elements, the catch elements can be provided on all or at least on some of the severing elements. The catch elements can there be present approximately at the position of the severing elements centered relative to the severing elements. It is understood that the catch elements are configured such that they do not contact the surface of the roll body of the other shaft during rotation of the shafts. The catch elements improve uncomminuted material to be drawn in at the feeding region of the two shafts.

The supporting elements can in the multi-region twin-shaft cutting system each at their smallest distance to the shaft center comprise a protective element or other suitable wear protection respectively facing the other shaft.

The protective element, the wear protection or special wear element on the supporting elements is typically attached at the point closest to the center, namely at the narrow side of the undulatory supporting elements and is used, for example, to protect this point because this point experiences the most stress during the comminuting process.

The two shafts can in the multi-region twin-shaft cuffing system be driven synchronously or asynchronously, where each of the shafts is exchangeable.

In particular the width of the support and severing elements is there crucial for asynchronous operation. Each of the two shafts can in the multi-region twin-shaft cutting system be driven hydraulically or mechanically via a gear or by a direct drive.

The varying loads acting upon the shafts during the rotation can be taken into account by synchronous or asynchronous driving. A gear or a direct drive can hydraulically or mechanically ensure the corresponding power transmission.

The invention further provides a comminuting device for comminuting material, comprising: a housing; a hopper device for filling in material; a multi-region twin-shaft cutting system as described above; a motor drive, in particular a servo motor or a torque motor, in particular an electric motor or a diesel engine for driving the shafts, and a discharge region for discharging the comminuted material, where the discharge region is preferably designed as a conveyor belt, a pusher, a flap or a scraper conveyor.

Therefore: 4 severing processes/severing planes arise in the new multi-region twin-shaft comminuting system during one passage due to the geometry and the severing element arrangements, i.e. during one rotation of the shafts driven in opposite direction, thereby making the comminuting process significantly more efficient.

BRIEF DESCRIPTION OF THE DRAWINGS

Further features and exemplary embodiments of the present invention are illustrated in more detail below using the drawings. It is understood that the embodiments do not exhaust the scope of the present invention. It is further understood that some or all features described hereafter can also be combined with each other in different ways.

DETAILED DESCRIPTION OF THE INVENTION

Figure 1:
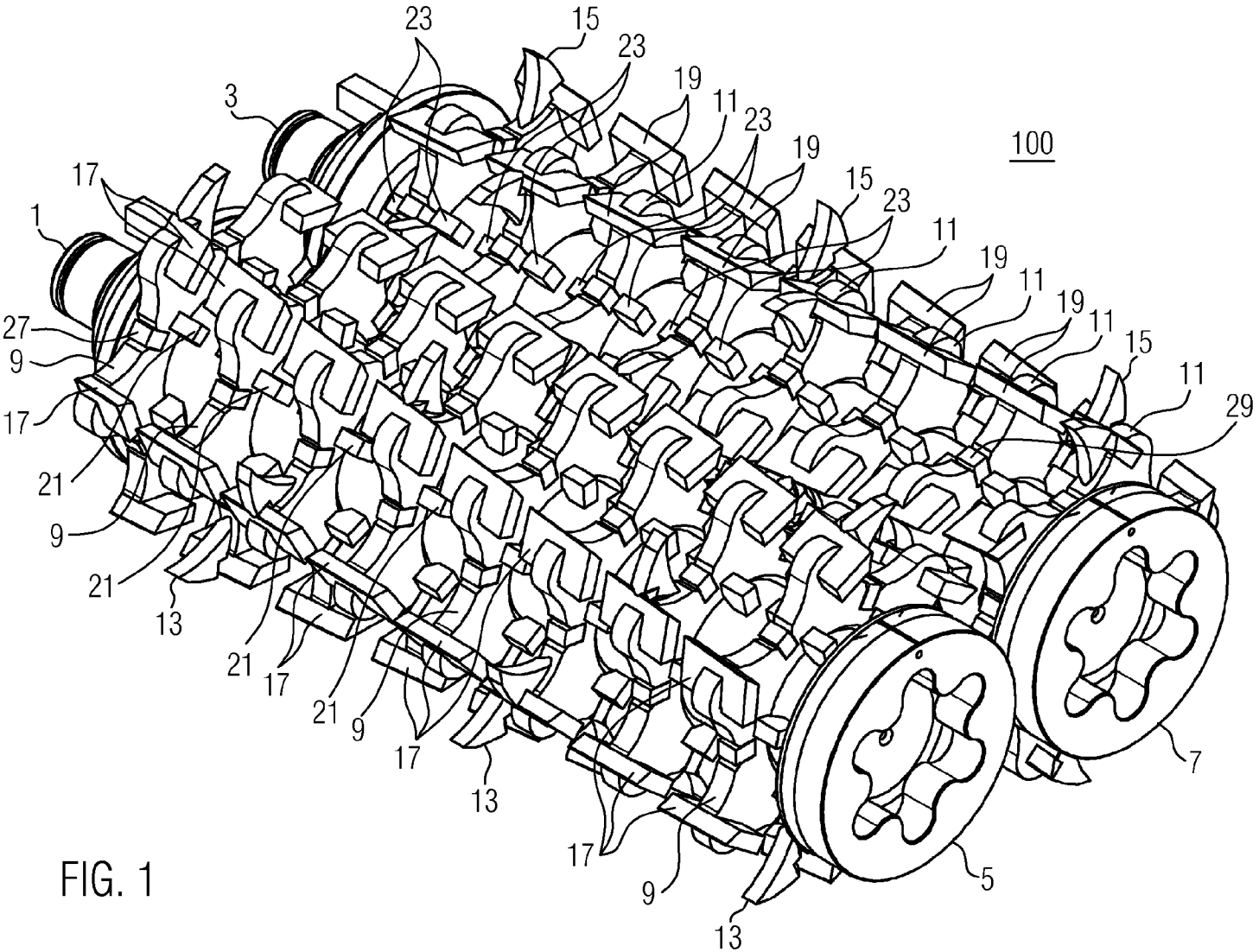
FIG. 1 represents a schematic diagram of a multi-region twin-shaft cutting system according to the present invention.

FIG. 1 shows a multi-region twin-shaft cutting system 100 according to the present invention. The multi-region twin-shaft cutting system 100 according to FIG. 1 shows two separate shafts 1 and 3 which are surrounded by a cylindrical roll body. It is understood that the shape of the roll body around the shaft can also have a different geometric shape, such as hexagonal or octagonal. Connection elements/couplings 5 and 7 are shown by way of example. The connection element/the coupling 5 for the left shaft 1 and the connection element/the coupling 7 for the right shaft 3 are shown in the illustrated arrangement of the cutting system 100 in FIG. 1. The two shafts 1 and 3 are arranged substantially parallel. The two shafts 1 and 3 are arranged driven in opposite manner. This means for FIG. 1 that the left shaft 1 rotates clockwise. The right shaft 3 accordingly rotates counterclockwise. The two shafts 1 and 3 can move synchronously or asynchronously. The shafts can in particular also rotate in the respective other direction of rotation, i.e. shaft 1 rotates counterclockwise and shaft 3 rotates clockwise. This option can be particularly advantageous for maintenance purposes or when an abnormal situation arises, for example, due to jamming of the shafts or of the severing elements, respectively. FIG. 1 shows further supporting elements 9 and 11 for the cutting system 100 which are provided axially with respect to the longitudinal axis of the shaft. The number of eight supporting elements 9 or 11 per shaft shown in FIG. 1 is to be understood as purely by way of example. It is also possible to provide a larger or small number of supporting elements per shaft in the cutting system. The supporting elements 9 and 11 are provided spaced in the axial direction. The spacings in the axial direction are in the present example substantially uniform. The supporting elements 9 and 11 of the shafts are typically designed such that they have a shaft-shaped or rosette-shaped circumferential fine of circumferential region. The shaft-shaped circumferential line promotes better circulation of the material to be comminuted and at the same time facilitates or optimizes the feeding process. Optimized circulation and an improved feeding process can reduce energy consumption for comminuting. The shaft shape is typically uniform, i.e. symmetrical around the circumference, where also an asymmetrical arrangement can be provided for improved comminuting. The number of maxima of the shaft-shape of the supporting elements can, for example, be designated by n, where n is a natural number. FIG. 1 shows a shaft shape with n=6. But it is understood that also other numbers of maxima and therefore also of minima are possible, for example, n=4 or n=8.

FIG. 1 also shows cap-tike protective elements 27 and 29 which are fitted to the supporting elements 9, 11 of the left shaft 1 and the right shaft 3. The protective elements 27 and 29 are in FIG. 1 provided by way of example in the region of the smallest distance of the shaft shape to the center of the supporting elements 9 and 11. Protective elements 27 and 29 can be fitted onto or suitably attached to supporting elements 9, 11 where any other suitable wear protection, as for example, by build-up welding, can be provided just as well instead of the protective elements 27 and 29.

The width of the spacing between two adjacent supporting elements 9 of shaft 1 or two adjacent supporting elements 11 of shaft 3 is as follows and explained from the perspective of shaft 1, i.e. the left-hand shaft. Severing elements 17 are provided on the supporting elements 9. The severing elements 17 are provided such that, when shafts 1 and 3 are driven in opposite manner, they can engage in the space between two adjacent supporting elements 11 of the other shaft. The space between two adjacent supporting elements 9 and 11, respectively, is therefore at least as wide as the width of the severing elements 17 and 19. When forming the severing elements 17 and 19 in slightly smaller width corresponding to the distance between the two supporting elements 9 and 11, respectively, also lateral comminuting occurs between the supporting and severing elements. This applies vice versa also for severing elements 19 which are supported by supporting elements 11 of shaft 3. For example, a severing element 17 of the left-hand shaft being provided in FIG. 1 on the first supporting element 9 of shaft 1 can therefore engage in the space between the first and the second supporting element 11, i.e. directly adjacent supporting elements, of the right shaft 3. Engagement occurs when shafts 1 and 3 are driven in an opposite manner. The supporting elements 9, 11 of the right and the left shaft in FIG. 1 each have a symmetry of six. This symmetry of six is evident, for example, when viewing the connection elements/couplings 5 and 7 in FIG. 1. The symmetry of six is also shown by the number of maxima of the shaft form of the circumferential line of supporting elements 9, 11, as described above. The severing elements 17 and 19 are each fitted substantially tangential at the circumferential region of the supporting elements 9 and 11. Six severing elements with reference numerals 17 and 19 are following the symmetry of six of the supporting elements 9 and 11 in FIG. 1 fitted on supporting element 9 respectively 11 in the circumferential direction. They are distributed substantially symmetrically but also asymmetrically at the circumferential region. The shafts are driven synchronously.

Furthermore, there is an advantage when drawing the material to be comminuted into the multi-region twin-shaft cutting system 100 when there is due to a larger angular distance a larger gap or there are several large gaps between severing elements 17 and 19 which are otherwise arranged at the same angular distance.

This means that the angular distance between two or more severing elements 17 at the supporting elements 9 in relation to the circumference of the shaft 1 is greater than for the other severing elements 17.

Similarly, the angular distance of severing elements 19 of supporting elements 11 of shaft 3 respectively corresponding to shaft 1 relative to the circumference of shaft 3 is greater than the angular distance of the other severing elements 19 of shaft 3 which are arranged at the same angular distance.

It is a matter of course that the respective counter severing elements 21 and 23 of shafts 1 and 3 are arranged at the same corresponding angular distance of severing elements 17 and 19 of shafts 1 and 3.

The distance in this example is therefore approximately 60°. Each of the six severing elements 17, 19, which are in FIG. 1 each attached to a supporting element 9, 11, can engage in the corresponding space between two directly adjacent supporting elements 11, 9 of the respective other shaft. This again means for the example shown in FIG. 1 that each severing element 17, which is from the perspective of the connection element/the coupling 5 of the left shaft 1 fitted to the first supporting element 9, can engage in the space between the first and the second supporting element 11 of right shaft 3 as seen from the perspective of the connection element/of the coupling 7. It is understood that respective correspondences apply for all other supporting elements 9, 11 and severing elements 17, 19 of the respective left and right shafts 1, 3. It is again pointed out that the symmetry of six, i.e., the number n of the severing elements on a supporting element is n=6, where n is a natural number, is chosen purely by way of example and that this number can just as well be n=4 or any other number. The severing elements of the left shaft are designated by reference numeral 17. The severing elements of the right shaft are designated by reference numeral 19.

Catch elements, for example, in the form of knives or catch hooks are further provided on the supporting elements 9 of the left shaft 1 and designated by reference numeral 13. Correspondingly, catch elements are provided on the supporting elements 11 of the left shaft 3 and designated by reference numeral 15. The catch elements 13 and 15, respectively, are in FIG. 1 in the axial direction provided only on some of the supporting elements 9, 11. It is understood, however, that catch elements 13, 15 can be provided both on some as well as on all supporting elements 9, 11. Purely by way of example, the catch elements 13, 15 are in FIG. 1 provided only on each third supporting element 9, 11. The catch elements 13 respectively 15 improve drawing material into the multi-shaft cutting system 100. The catch elements 13 respectively 15 can in relation to the circumferential direction of a supporting element 9 respectively 11 be provided, for example, on every second severing element of a supporting element 9, 11. The catch elements 13, 15 can there be provided separately or a specific severing element can be provided resulting in a combination of a catch element and a severing element. The catch elements 13 and 15 are for example, bent hook-like, knife-like or sickle-like with respect to the normal direction of rotation. The arrangement of some catch elements 13 and 15, respectively, against the normal direction of rotation can also be provided so that the work material leading to the blockage can be loosened in the event that shafts 1 and 3 are blocked and reverse operation is necessary. This is to be understood in that the left shaft 1 in FIG. 1 typically rotates clockwise and the right shaft 3 rotates counterclockwise thereto. The material to be comminuted is then according to the direction of rotation of the shafts 1, 3 fed above the two shafts to the cutting system 100. A feeding or inlet region is therefore defined, for example, by an imaginary plane through both longitudinal axes of the two shafts 1, 3. The region above this imaginary plane is to be described as the feeding region. The hook-like, knife-like or sickle-like shape of the catch elements 11, 15 improves drawing into the feeding region. A discharge region relative to the direction of rotation of the shafts 1, 3 is provided below this imaginary plane. The comminuted material is in this discharge region, for example, removed from the cutting system 100 or drops out by itself due to gravity. FIG. 1 further shows counter severing elements 21 of the left shaft 1 and 23 of the right shaft 3. The counter severing elements 21 respectively 23 also correspond to the symmetry of six shown in FIG. 1. This means that six counter severing elements 21, 23 are arranged, for example, directly adjacent to the left and to the right of a supporting element 9, 11 on the surface of the roll body of the shafts. The counter severing elements 21, 23 are arranged such that they correspond to the severing elements 17, 19 of the supporting elements 9, 11 of the respective other shaft. The counter severing elements 21 of the left shaft therefore, for example, correspond to the severing elements 19 of the right shaft. Similarly, the counter severing elements 23 of the right shaft correspond to the severing elements 17 of the left shaft. This correspondence leads to a respective severing element 17, 19 of the one shaft 1, 3 can, when the two shafts are driven in an opposite manner, operate counter to a corresponding counter severing element 21, 23 of the other shaft 3, 1. Material can in particular thereby advantageously be comminuted between the severing element 17, 19 and the corresponding counter severing elements 21, 23. The counter severing elements 21 and 23 are provided substantially perpendicular to the supporting elements 9 and 11, respectively. The counter severing elements 21, 23 are in FIG. 1 shown such that they do not fill the entire space between two supporting elements 9, 11 of a shaft 1, 3 in relation to the axial direction. It is understood that the counter severing elements 21 and 23 can each be designed as being both continuous as well as discontinuous between two supporting elements 9, 11. A counter severing element 21, 23 can therefore within the space be discontinuous in the axial direction. One can also refer to such a counter severing element as being two-part or multipart. It is important, however, that the counter severing element 21, 23 being of a single-part or multi-part form each corresponds to the corresponding severing element 17, 19 of the respective other shaft. The severing elements 17 and 19 can at their leading edge be beveled, i.e. the edge that with respect to the direction of rotation substantially first contacts the material to be comminuted, as shown in the following FIGS. 3A-3C. The leading edge of the respective severing elements 17, 19 can also have an angle contrary to the longitudinal direction of the shaft 1, 3. The angle can be between 0° and 90°, preferably between 0° and 45°. It is also evident from FIG. 1 that the supporting elements 9 respectively 11 of the left and the right shaft 1, 3 are each arranged offset against each other by a few degrees. This arrangement is also evident in the subsequent figures. The drawn-in and comminuting motion of the shaft 1, 3 is thereby further enhanced.

Figure 2B:
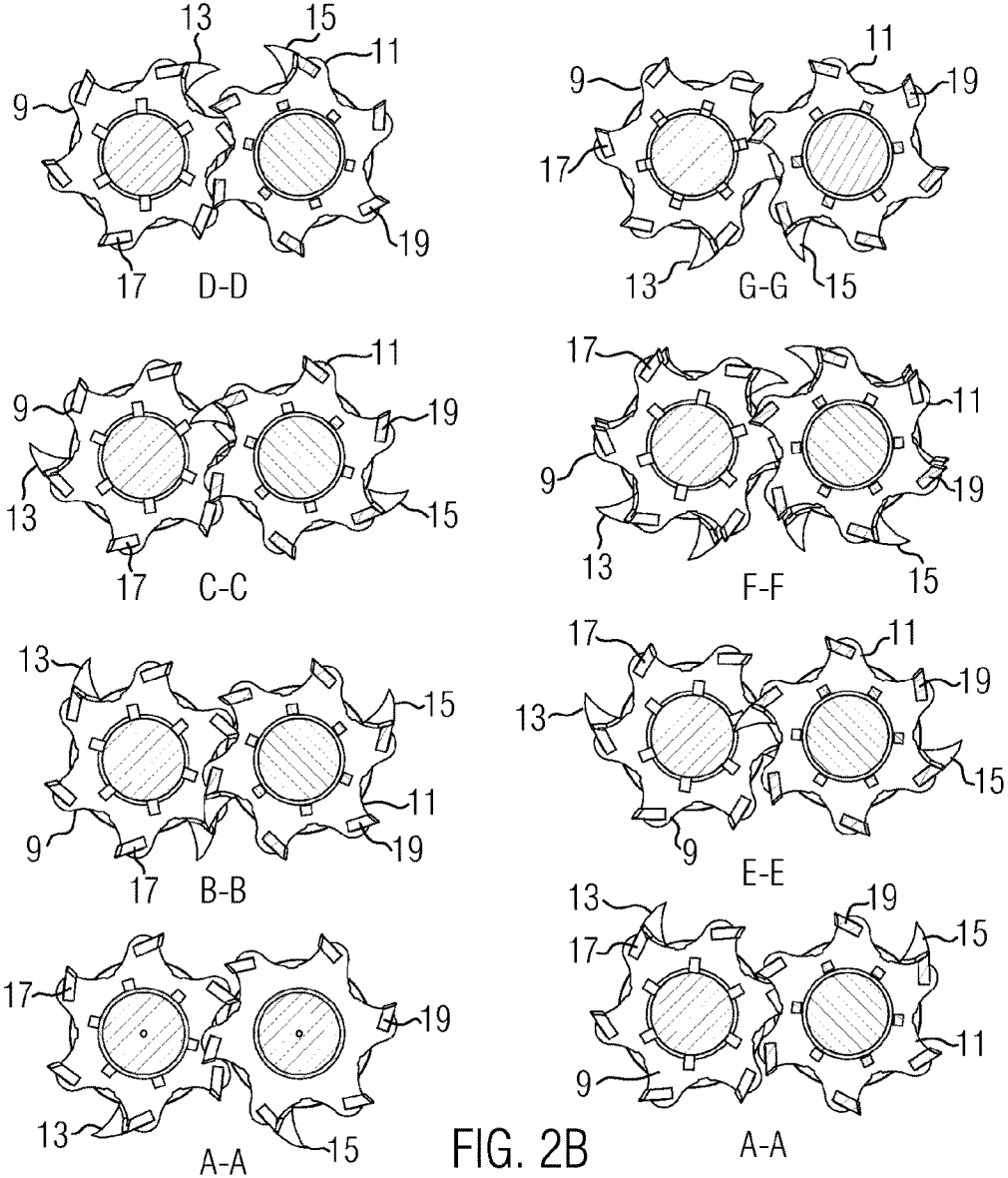
FIG. 2B represents schematic sectional views transverse to the longitudinal direction through the cutting system of FIG. 2A.
Figure 2C:
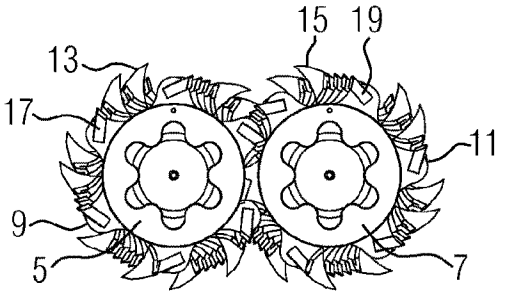
FIG. 2C represents a view in the longitudinal direction of the shafts of the cutting system of FIG. 2A.
Figure 2A:
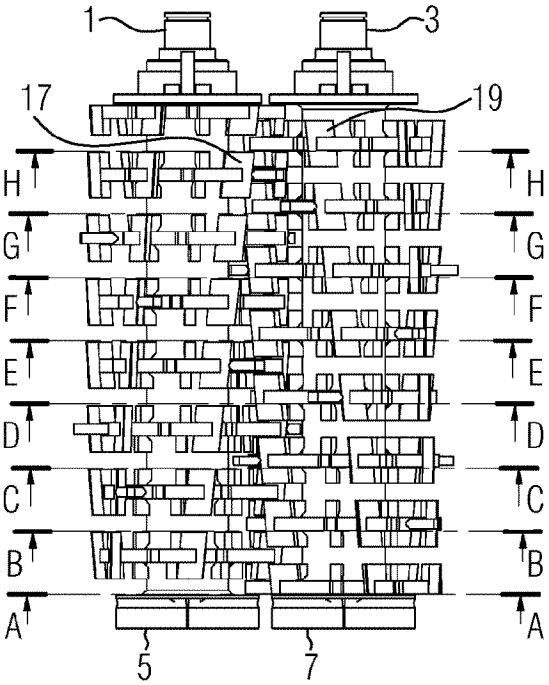
FIG. 2A represents a schematic plan view of the multi-region twin-shaft cutting system of FIG. 1.

FIG. 2 in three partial FIGS. 2A, 2B, 2C shows views and sections of the cutting system 100 as shown in FIG. 1. A plan view is shown in FIG. 2A onto the cutting system 100 with shafts 1 and 3. It is in this view clearly evident how the supporting elements of the left shaft 1 and the right shaft 3 are arranged with respect to the engagement/meshing. Eight sectional views are shown individually in FIG. 2B by way of example perpendicular (transverse) to the longitudinal axis of both shafts 1 and 3 and designated by AA. B-B, . . . , H-H. It is clearly evident in the sectional views that the catch elements/teeth 13 of left shaft 1 and the catch elements 15 of the right shaft 3 are provided on supporting elements 9 of the left shaft and supporting elements 11 of the right shaft. A depicted supporting element 11 of the right shaft 3 is in sectional views A-A, B-B, . . . H-H respectively located in front of a depicted supporting element 9 of the left shaft. A total of 12 catch elements 13 and 15 are shown in sectional views A-A. B-B, . . . H-H. As already mentioned above, it is understood that a different number of catch elements is possible.

FIG. 2C shows a view in the longitudinal direction of the shafts 1 and 3 with a plan view onto the connection elements/couplings 5 and 7. The arrangement of the knives 19 and catch elements 15 of the right shaft 3 and the arrangement of the knives 17 and catch elements 13 of the left shaft 1 can be clearly seen.

Figure 3A:
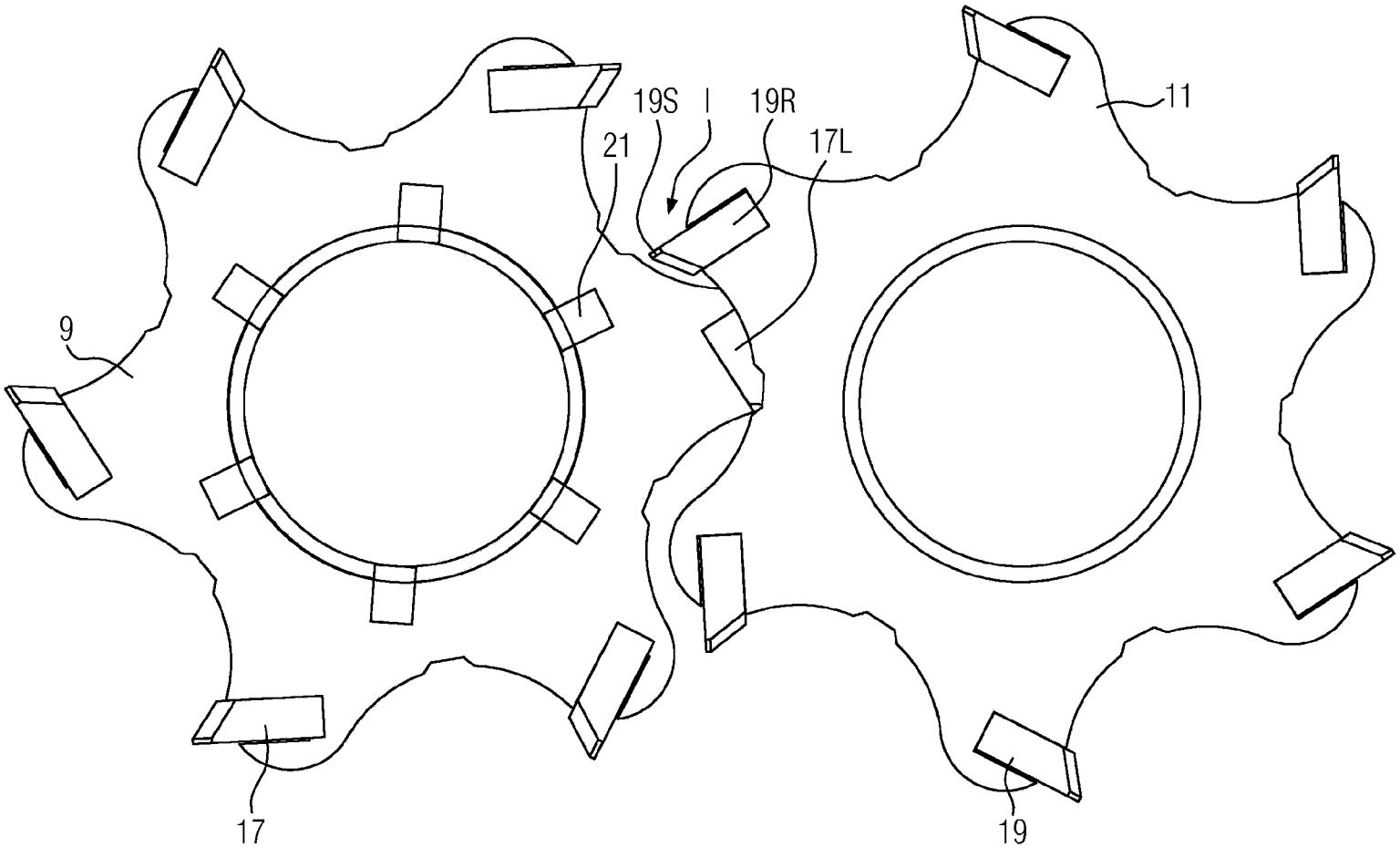
FIGS. 3A-3C schematically show the specific arrangement of supporting elements, severing elements and counter severing elements regarding the comminuting of material.
Figure 3B:
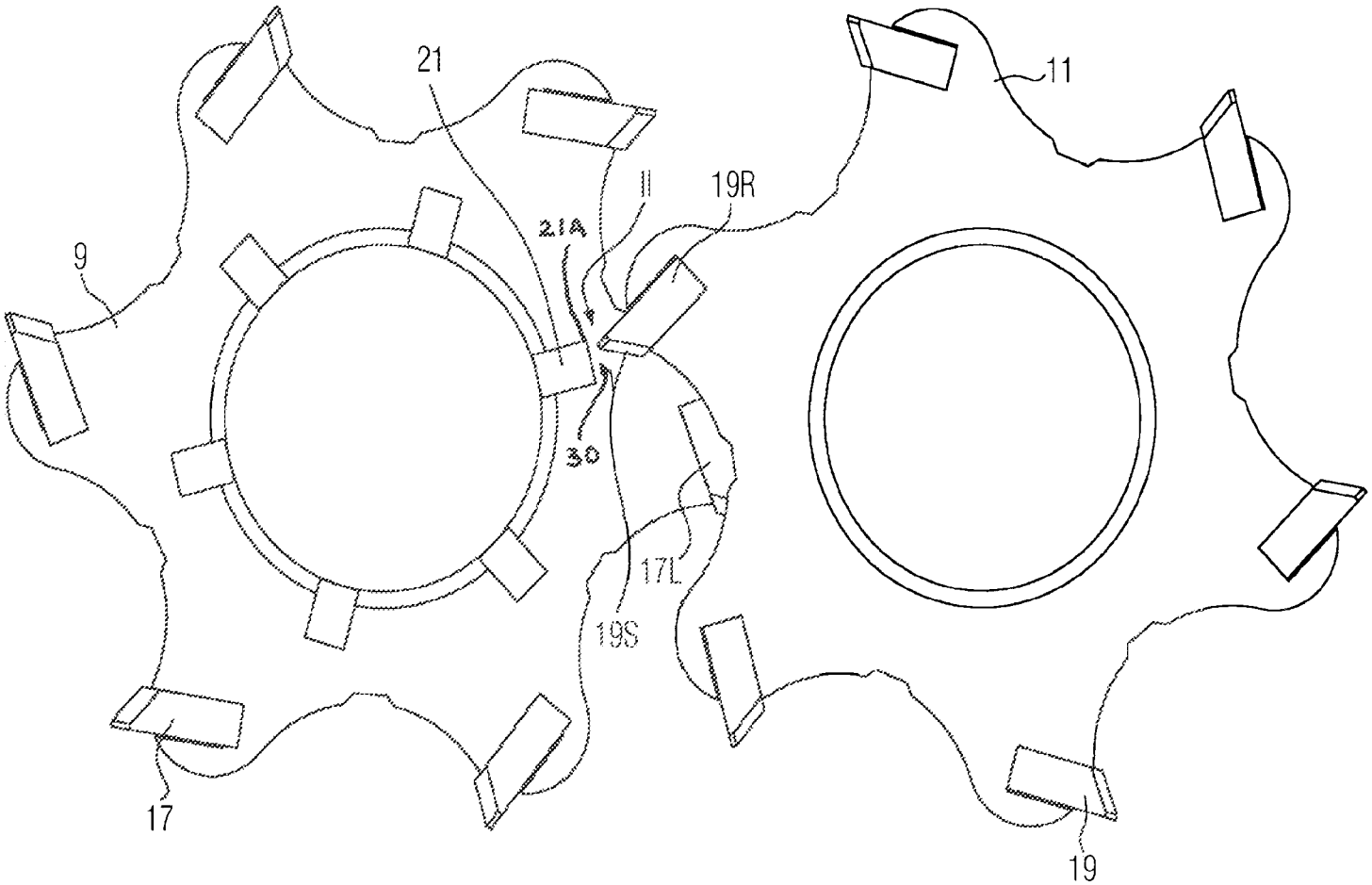
Figure 3C:
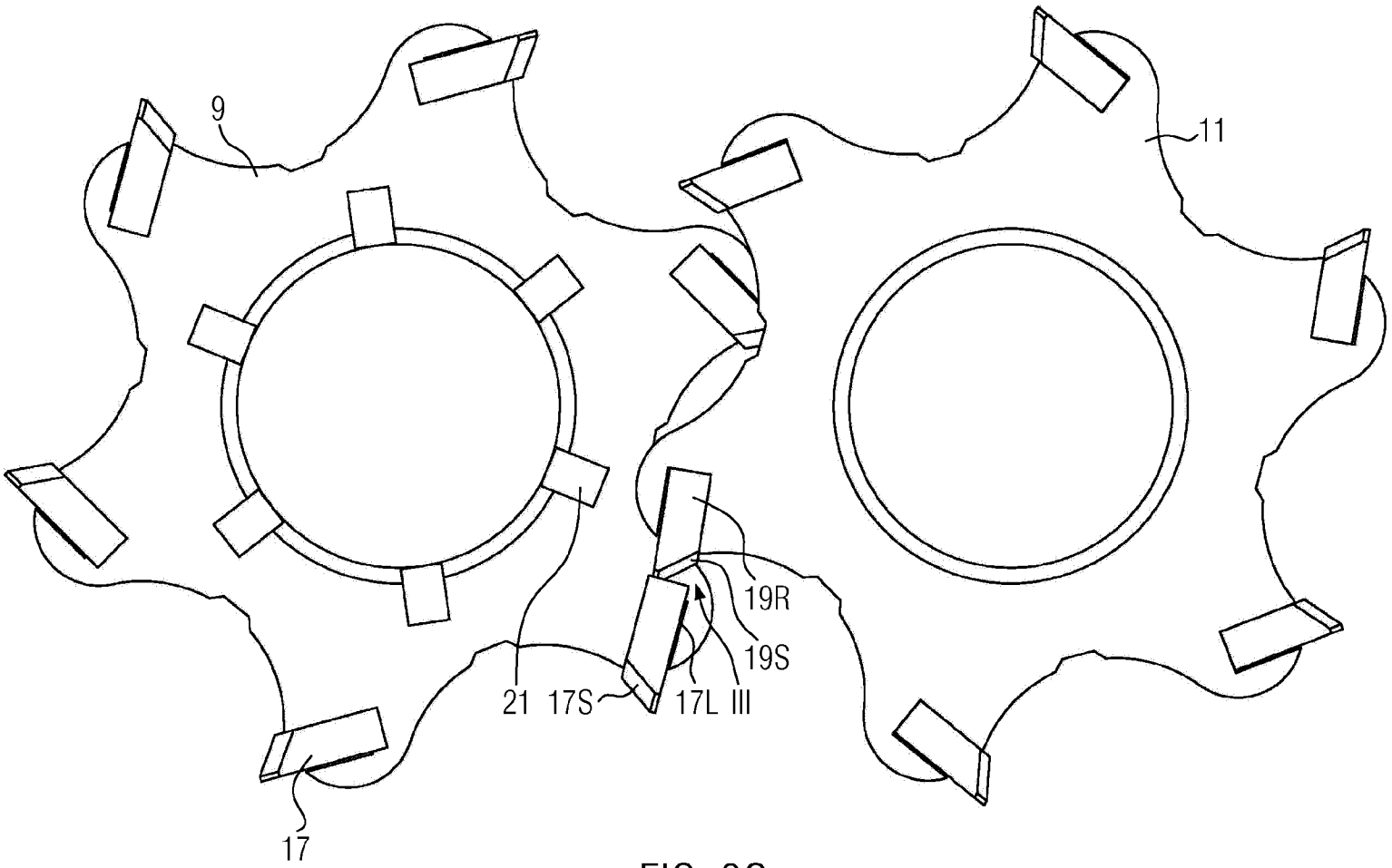

FIGS. 3A to 3C show the correspondences during one rotation arising merely by the arrangement of the supporting elements 9, 11, the severing elements 17, 19 and the counter severing elements 21, 23 and their respective effects. The catch elements 13, 15 have in FIGS. 3A to 3C been omitted for reasons of clarity.

It is in the sectional views of FIGS. 3A to 3C first clear that one supporting element 9 of the left shaft 1 is by way of example located behind a supporting element 11 of the right shaft. The outer circumference of the supporting element 9 of the left shaft 1 thereby engages with the space between the supporting element 11 of the right shaft 3 and a supporting element 11 of the same shaft 3 immediately adjacent behind it. The severing elements 17 of the left shaft 1 and 19 of the right shaft 3 are also to be seen. The severing elements 17 and 19 show a beveled knife-like or blade-like region 17S and 19S, respectively.

The feeding region of the cutting system 100 is in FIG. 3A denoted by I. The supporting elements 9 of the left shaft 1 and the supporting elements 11 of the right shaft 3 engage when driven in an opposite manner. In the sectional views of FIGS. 3A to 3C, this means by way of example that the supporting element 11 is in the sectional view located in front of the supporting element 9. Two severing elements 19R and 17L are indicated. Of the element 19R, also the front beveled portion 19S of the severing element is shown. It is understood that the supporting element 9 engages directly between the supporting element 11 and a further supporting element of the right shaft located further behind supporting element 11. The motion of the two shafts 1, 3 in an opposite manner in the feeding region I causes the material to be comminuted to be drawn in, torn and/or broken between the severing element 19R of the right shaft 3 and the severing element 17L of the left shaft 1. This comminuting seen in the sectional view therefore occurs substantially in the axial direction. The undulatory circumference line of the supporting elements 9, 11 supports this comminuting process. During the same rotation, the left shaft 1 continues to rotate clockwise and the right shaft 3 counterclockwise. The left supporting element 9 and the right supporting element 11 thereby also continue to rotate.

In FIG. 3B, region II indicates the right severing element 19R and the corresponding left counter severing element 21 having a leading edge 21A that comprises cutting area 30. The severing element 19R and the counter severing element 21 approach each other during rotation to a degree that the material to be comminuted is severed and/or cut between the severing element 19R of the right shaft 3 and the counter severing element 21 of the left shaft 1 in the cutting area 30. The counter severing element 21 is in the form shown there illustrated as having the shape of an anvil. Instead of an anvil shape, however, a blade-like shape can also be chosen in order to ensure severing of the material in a cutting manner.

It is again understood that the correspondence between severing element 19, 17 and counter severing element 21, 23 is there shown only by way of example for one severing element 19R of the right shaft 3 and corresponding counter severing element 21 of the left shaft 1. Conversely, there is a respective correspondence likewise between severing elements 17 of the left shaft 1 and counter severing elements 23 of the right shaft 3. FIG. 3C during the same rotation, in correspondence to the arrangement of severing elements 19R and 17L, shows a further comminuting process that follows the second and the third comminuting process in sequence. Severing element 19R is there the same severing element as shown in FIG. 3B. Severing element 19R of supporting element 11 of the right shaft can there operate counter to the back side of the severing element of the left shaft 17L, so that the material to be comminuted is once more comminuted and/or cut. This repeated comminuting occurs in the discharge region III of the cutting system. This therefore results in a very uniform end product virtually free of oversize particles while reducing energy consumption. It can be directly entered into further marketing. Material is thereby due to the arrangement of the supporting elements 9, 11. the severing elements 17, 19, the counter severing elements 21, 23 during one rotation of the two shafts 1, 3, sequentially comminuted firstly by severing elements 17, 19, between severing elements 9, 11 and in the three regions I, II, III. One can therefore also speak of a four-time cutting or comminuting effect which is caused by the arrangement of the supporting elements, the severing element and the counter severing elements on the shafts.

It is understood that the cutting system 100 according to FIG. 1 being explained in more detail with reference to FIGS. 2A, 2B, 2C, 3A, 3B3C can be provided within a comminuting device (presently not shown). Such a comminuting device can comprise a funnel-like attachment, a hopper, into which the material to be comminuted is entered. This funnel-like attachment can typically be provided above the feeding region of the cutting system 100. The material is drawn into the feeding region due to the rotation of the shafts in an opposite manner. The teeth 13 and 15 there have a supporting effect. It is possible to provide a pressing system that respectively presses the material to be comminuted into the hopper and thereby into the comminuting unit. A system can be provided below the cutting system 100 (presently not shown) that is suited to retain oversize particles contained in the comminuted material and discharges it accordingly and, for example, transports it away from the cutting system 100 for further use via a conveyor belt. The cutting system 100 can therefore be provided in a mobile, semi-mobile or stationary comminuting device.

The invention claimed is:

1. A multi-region twin-shaft cutting system for comminuting material, comprising:

two shafts which are arranged in parallel and are driven in an opposite direction, wherein each shaft is surrounded by a roll body;

a multiplicity of supporting elements, wherein each of said supporting elements is fitted radially around said roll body, wherein each of said supporting elements has a radial, undulatory, rounded or angular or edged, symmetrical or asymmetrical circumferential line; and a multiplicity of severing elements which have a configuration chosen from the group consisting of disc-shaped and plate-shaped and are each fitted tangentially to the circumferential line of said supporting elements, wherein said supporting elements are arranged at a distance around said roll bodies such that one severing element on one supporting element of each shaft of said two shafts engages between two directly adjacent supporting elements of the other shaft of said two shafts, wherein, for each shaft of said two shafts, counter severing elements are respectively fitted between two directly adjacent supporting elements of said each shaft, on said roll body of said each shaft, said counter severing elements having a leading edge comprising a cutting area and being fitted in a corresponding manner to said severing elements of the other shaft of said two shafts such that said severing elements of said other shaft, on opposite engagement in an intermediate space of said two directly adjacent supporting elements of said each shaft, operate counter to said corresponding counter severing elements, such that said material is comminuted, wherein each of said severing elements of said each shaft are each arranged in corresponding manner to said severing elements and a respective one of said counter severing elements of said other shaft such that, on opposite engagement of said severing elements of said two shafts, one of the severing elements of said each shaft operates counter to a corresponding severing element and said respective one of said counter severing elements of said other shaft, wherein a leading edge of said severing element of said each shaft operates counter to an edge facing away from a leading edge of said corresponding severing element of said other shaft and counter to the cutting area of said respective one of said counter severing element of said other shaft.

2. The multi-region twin-shaft cutting system according to claim 1, wherein each of said severing elements of said each shaft have leading edges, respectively, wherein each of said severing elements of said each shaft comprise said cutting area positioned at least at leading edges of the severing elements and positioned relative to said leading edge of said counter severing elements of said other shaft.

3. The multi-region twin-shaft cutting system according to claim 1, wherein said severing elements of said each shaft are formed such that a width is smaller than the respective distance between said two oppositely disposed supporting elements, so that on opposite engagement of said severing elements of said two shafts with said oppositely disposed supporting elements, a severing element of said each shaft operates laterally counter to two directly adjacent supporting elements of said other shaft.

4. The multi-region twin-shaft cutting system according to claim 1, wherein said severing elements of said each shaft are each arranged in corresponding manner to said severing elements of said other shaft such that, on opposite engagement of said severing elements of said two shafts, a severing element of said each shaft operates counter to a directly adjacent severing element of said other shaft.

5. The multi-region twin-shaft cutting system according to claim 1, wherein said severing elements of said each shaft are each arranged in corresponding manner to said severing elements of said other shaft and said counter severing elements of said other shaft such that, during a single opposite rotation of said two shafts on opposite engagement of said severing elements of said two shafts, initially one severing element of said each shaft operates counter to a directly adjacent pair of supporting elements of said other shaft, wherein a same rotation of said two shafts on opposite engagement of said severing elements of said two shafts, initially one severing element of said each shaft operates laterally counter to a directly adjacent pair of supporting elements of said other shaft, then said severing element of said each shaft operates counter to said counter severing elements of said other shaft corresponding to said severing element of said each shaft, and then said severing element of said each shaft operates counter to said severing element of said other shaft, said severing element of said other shaft is fitted in a corresponding manner to said severing element of said each shaft, counter to an edge facing away from said leading edge of said severing element of said each shaft.

6. The multi-region twin-shaft cutting system according to claim 1, wherein each severing element of said each shaft corresponds to two counter severing elements of two directly adjacent supporting elements of said other shaft, wherein said two counter severing elements are spaced in the axial direction between said two supporting elements.

7. The multi-region twin-shaft cutting system according to claim 1, wherein said counter severing elements are provided directly at said supporting elements on said roll body.

8. The multi-region twin-shaft cutting system according to claim 1, wherein said counter severing elements are ashlar-shaped or rectangular and provided in the axial direction perpendicular to said supporting elements.

9. The multi-region twin-shaft cutting system according to claim 1 wherein said leading edges of said counter severing elements face said other shaft.

10. The multi-region twin-shaft cutting system according to claim 1, wherein said supporting elements each, at a smallest distance to the shaft center, comprise a protective element respectively facing said other shaft.

11. The multi-region twin-shaft cutting system according to claim 1, wherein said leading edges of said severing elements of each shaft are arranged in the axial direction parallel to the longitudinal axis of said each shaft or wherein said leading edges of said severing elements of each shaft are arranged with an inclination at an angle a relative to the longitudinal axis of said each shaft, where $0° < \alpha < 90°$.

12. The multi-region twin-shaft cutting system according to claim 11, wherein said counter severing elements of said other shaft corresponding to said severing elements of said each shaft are arranged according to said inclination of said corresponding severing elements.

13. The multi-region twin-shaft cutting system according to claim 1, further comprising a multiplicity of catch elements that are fitted to at least some of said supporting elements on an outer circumference of said catch elements radially to the longitudinal axis of said each shaft, wherein said catch elements are typically bent in a hook-shaped configuration so that said catch elements primarily point towards said other shaft.

14. The multi-region twin-shaft cutting system according to claim 1, wherein said two shafts are driven synchronously or asynchronously.

15. The multi-region twin-shaft cutting system according to claim 1, where each of said two shafts is driven hydraulically or mechanically via a gear or by a direct drive.

16. A comminuting device for comminuting material, comprising:

a housing;

a hopper device for filling in said material;

a multi-region twin-shaft cutting system according to claim 1;

a motor drive comprising a servo motor or a torque motor, and a discharge region for discharging and for retaining oversize particles of said comminuted material, wherein said discharge region is designed as a conveyor belt, a pusher, a flap or a scraper conveyor.

17. The multi-region twin-shaft cutting system according to claim 2, wherein the cutting area is beveled.

18. The multi-region twin-shaft cutting system according to claim 9, wherein the cutting area is beveled.

* * * * *